US010865020B2

(12) United States Patent
Herling et al.

(10) Patent No.: US 10,865,020 B2
(45) Date of Patent: Dec. 15, 2020

(54) DRINKING CONTAINER WITH SLIDING CLOSURE

(71) Applicant: Marc Heinke, Oakville (CA)

(72) Inventors: Nicholas Herling, Oakville (CA); Marc Heinke, Oakville (CA)

(73) Assignee: Marc Heinke, Oakville (CA)

( * ) Notice: Subject to any disclaimer, the term of this patent is extended or adjusted under 35 U.S.C. 154(b) by 299 days.

(21) Appl. No.: 15/625,472

(22) Filed: Jun. 16, 2017

(65) Prior Publication Data

US 2018/0050847 A1 Feb. 22, 2018

Related U.S. Application Data

(60) Provisional application No. 62/351,710, filed on Jun. 17, 2016.

(51) Int. Cl.
*B65D 43/20* (2006.01)
*B65D 77/28* (2006.01)
(Continued)

(52) U.S. Cl.
CPC ..... *B65D 43/20* (2013.01); *A47G 19/2272* (2013.01); *A47G 21/186* (2013.01); *B65D 41/02* (2013.01); *B65D 43/12* (2013.01); *B65D 47/066* (2013.01); *B65D 47/286* (2013.01); *B65D 51/18* (2013.01); *B65D 53/00* (2013.01); *B65D 77/283* (2013.01); *B65D 2205/02* (2013.01); *B65D 2251/009* (2013.01); *B65D 2251/0018* (2013.01); *B65D 2251/0028* (2013.01); *B65D 2251/0078* (2013.01); *B65D 2251/0087* (2013.01)

(58) Field of Classification Search
CPC .... B65D 43/20; B65D 47/286; B65D 47/066; B65D 77/283; B65D 51/18; B65D 43/12; A47G 21/186; A47G 19/2272
See application file for complete search history.

(56) References Cited

U.S. PATENT DOCUMENTS 866,486 A * 9/1907 Kovacic ..... B65D 47/286 220/348
2,517,182 A * 8/1950 Draper ..... B43L 25/00 15/257.073
(Continued)

FOREIGN PATENT DOCUMENTS

CA 2743812 A1 12/2012
CA 2783305 A1 8/2013
(Continued)

OTHER PUBLICATIONS http://www.asobubottle.com/product/61.html, May 12, 2016.
(Continued)

*Primary Examiner* — Don M Anderson

(57) ABSTRACT

A drinking container comprising a vessel; a cap, atop said vessel; a flexible drinking straw extending from said cap, in flow communication with an interior of said vessel; a slidable, generally flat lid defining a cavity between said cap and said lid; wherein said lid is generally co-extensive with a top of said cap, and is slidably mounted to said cap to slide between an open position in which said flexible straw is extended for drinking, to a closed position in which said straw is flexed into said cavity.

10 Claims, 8 Drawing Sheets

(51) Int. Cl.

| | |
|---|---|
| ***B65D 47/28*** | (2006.01) |
| ***B65D 43/12*** | (2006.01) |
| ***A47G 19/22*** | (2006.01) |
| ***A47G 21/18*** | (2006.01) |
| ***B65D 41/02*** | (2006.01) |
| ***B65D 47/06*** | (2006.01) |
| ***B65D 51/18*** | (2006.01) |
| ***B65D 53/00*** | (2006.01) |

(56) References Cited

U.S. PATENT DOCUMENTS

| | | | | |
|---|---|---|---|---|
| 3,278,009 | A | 10/1966 | Crump | |
| 5,107,990 | A | 4/1992 | Wicherski et al. | |
| 6,279,773 | B1 * | 8/2001 | Kiyota | A47G 19/2266 220/709 |
| D584,102 | S | 1/2009 | Valderrama et al. | |
| 7,926,653 | B2 | 4/2011 | Tawada et al. | |
| 2005/0115967 | A1 * | 6/2005 | Conaway | A47G 19/2266 220/254.1 |
| 2010/0170902 | A1 * | 7/2010 | Britto | A47G 19/2266 220/367.1 |
| 2011/0226772 | A1 | 9/2011 | Adler et al. | |
| 2012/0312816 | A1 | 12/2012 | Barreto et al. | |
| 2014/0175042 | A1 | 6/2014 | Lane | |

FOREIGN PATENT DOCUMENTS

| | | | |
|---|---|---|---|
| CN | 203111801 | U | 8/2013 |
| EP | 2532601 | A1 | 12/2012 |
| WO | 2008131437 | | 10/2008 |

OTHER PUBLICATIONS http://www.nathansports.com/hydration/bottles-flasks/flip-straw-frosted-tritan, May 14, 2016.

http://www.copybook.com/packaging/companies/the-box-bv/articles/plain-silver-tins; Jan. 27, 2012.

http://www.noodlesoup.com/juice2go.aspx, Sep. 25, 2015.

Partial European Search Report dated Oct. 25, 2017 in relation to European Patent Application No. 17176315.4, filed Jun. 16, 2017.

* cited by examiner

DRINKING CONTAINER WITH SLIDING CLOSURE

CROSS-REFERENCE TO RELATED APPLICATIONS

This application claims priority to U.S. Provisional Application No. 62/351,710 filed Jun. 17, 2016, the contents of which are hereby incorporated by reference.

TECHNICAL FIELD

This relates to drinking containers, and more particularly drinking containers with sliding closures.

BACKGROUND

In the modern age, transporting food and drink for consumption is typical.

A variety of food and beverage containers are therefore known. Many beverage/drinking containers, however, do not adequately keep liquid from spilling. Others are hard to open. Yet others are mechanically complex, and expensive to manufacture.

Accordingly, there remains a need for new drinking containers.

SUMMARY

According to an aspect, there is provided a drinking container comprising a vessel; a cap, atop the vessel; a flexible drinking straw extending from the cap, in flow communication with an interior of the vessel; a slidable lid defining a cavity between the cap and the lid; wherein the lid is slidably mounted to the cap to slide between an open position in which the flexible straw is extended for drinking and a portion of said lid overhangs beyond an outer edge of said cap, to a closed position in which the straw is flexed into the cavity and the lid is co-extensive with a top of said cap.

According to another aspect, there is provided a drinking container comprising a vessel, having upstanding front and rear walls; a cap; a lid defining a cavity between the cap and lid and slidably mounted to the cap to slide forward and backward on the cap between an open position in which a portion of said lid overhangs beyond an outer edge of said cap, to a closed position in which the lid is co-extensive with a top of said cap; a tab extending from a rear of the vessel above a top surface of the vessel; a stop extending downwardly from the lid to engage with the tabs to prevent the lid from being slid from the cap, when the cap is mounted atop the vessel.

Other features will become apparent from the drawings in conjunction with the following description.

BRIEF DESCRIPTION OF THE DRAWINGS

In the figures which illustrate example embodiments.

DETAILED DESCRIPTION

Figure 1:
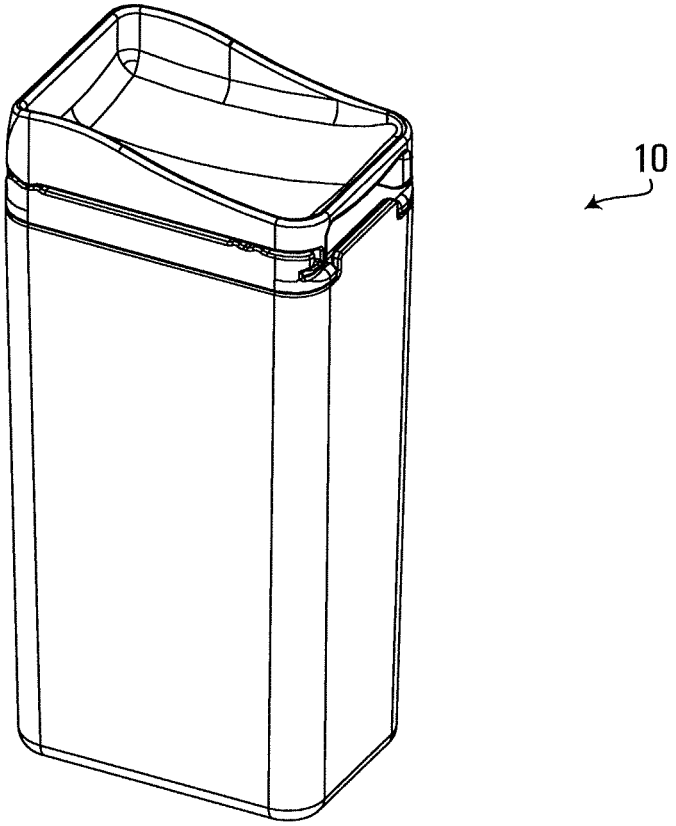
FIG. 1 is a perspective view of a drinking container, exemplary of an embodiment.
Figure 2:
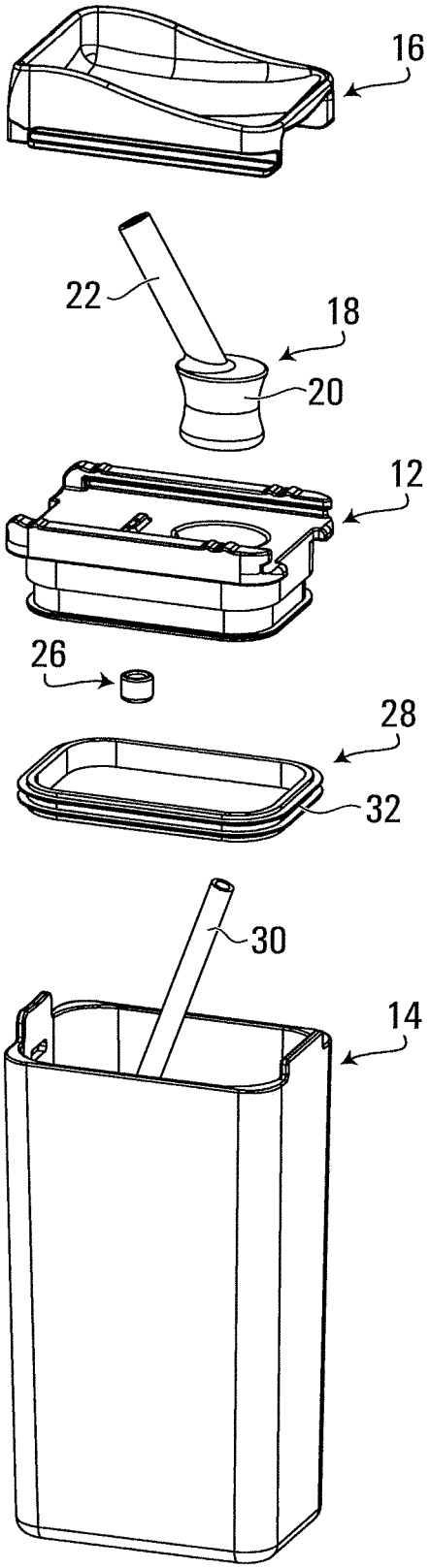
FIG. 2 is an exploded view of the drinking container of FIG. 1.
Figure 3A:
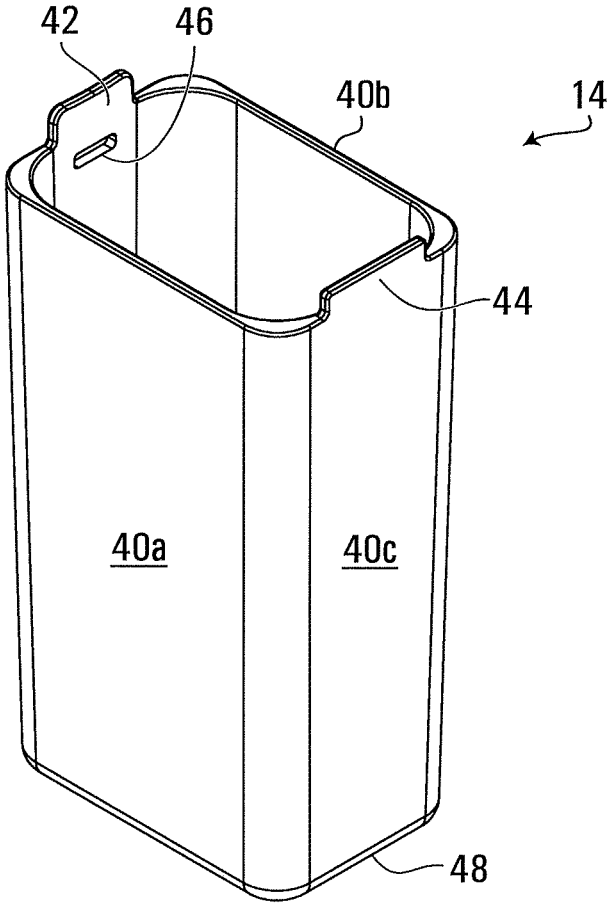
FIG. 3A is a perspective of a drinking vessel of the container of FIG. 2.
Figure 3B:
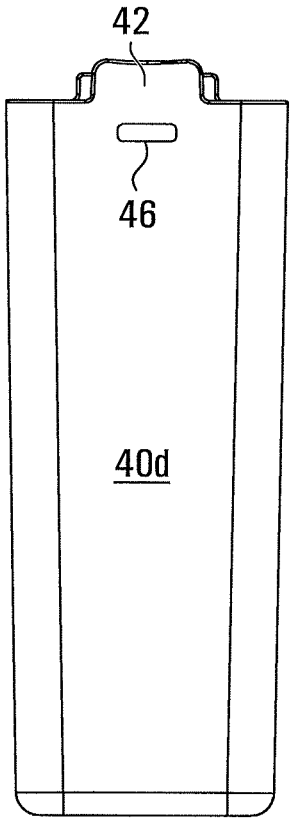
FIGS. 3B-3D are front side and rear views of the vessel of FIG. 3A.
Figure 3C:
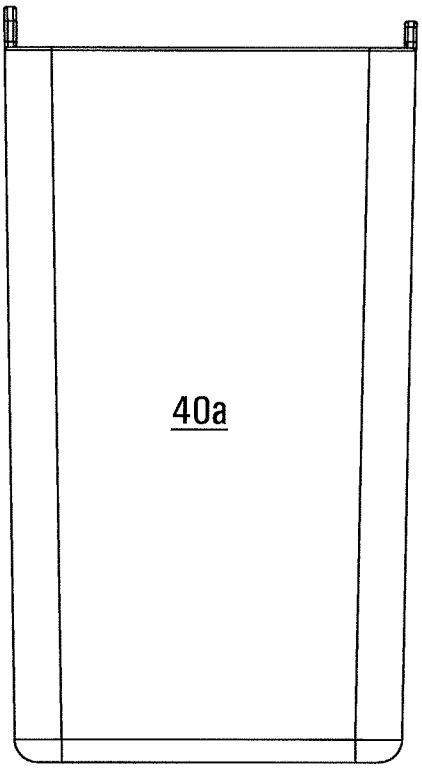
Figure 3D:
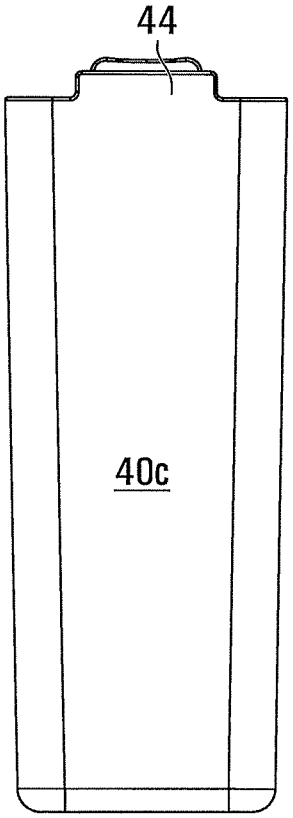

FIG. 1 is a perspective view of a drinking container 10, exemplary of an embodiment. An exploded view of container 10 is depicted in FIG. 2. Container 10 is generally intended for transporting a quantity of potable liquid, for example in the form of juice, milk, water or the like for consumption on the go.

To that end, and as illustrated, container 10 includes a generally concave vessel 14 for storing the liquid. A subassembly formed of a container cap 12, straw assembly 18 and lid 16 may be placed atop of a full vessel 14 for transport and dispensing of liquid.

A straw 30 extends into vessel 14 and through its top opening. Straw 30 preferably extends to the bottom of vessel 14 to allow vessel 14 to be emptied there through. Straw 30 may be removable from vessel 14, and may be formed of plastic or silicone.

Container cap 12 engages and closes the top opening of vessel 14. Cap 12 is shaped to conform to the upper opening of vessel 14.

Drinking straw assembly 18 extends from container cap 24. Drinking straw assembly 18 includes a base 20 for interconnection with cap 12, and a flexible straw 22 in fluid communication with straw 30, and thereby the interior of vessel 14. Flexible straw 20 surrounds the tip of straw 30. These may be coaxial. Flexible straw 22 thereby allows liquid to be withdrawn from vessel 14 by via straw 30 and flexible straw 22. Base 20 may be formed of rubber, and may be friction fit into a complementary opening in cap 12. Flexible straw 22 extends generally upwardly, but may be bent forward or backward. Its natural tendency will be to resile into an upward orientation. Conveniently, flexible straw 22 may extend at a suitable angle from base 20, so that straw 30 when inserted therein rests against the front edge of base of vessel 14. Of course, the length of straw 30 may be dimensioned adequately to intersect with the front edge of the base of vessel 14.

A seal 28 seals container cap 12 to vessel 14. Seal 28 conforms to the edge of the upper opening of vessel 14, and is interposed between cap 12 and vessel 14. Seal 28 may be formed of a flexible polymer, rubber or the like. Seal 28 may include one or more outwardly extending ribs 32 that further bind seal 28 to vessel 14.

Lid 16 is slidably mounted to the top of cap 12 and seals flexible straw 22 to container 10, as detailed below.

Vessel 14 is further depicted in FIGS. 3A-3D. As illustrated, vessel 14 is generally rectangular, and includes four upwardly extending wall—two opposing side walls 40*a*, 40*b* and a front and a rear wall 40*d* and 40*c*, extending from a generally flat bottom base 48. Front wall 40*d* includes an upwardly extending front tab 42, and an engagement notch/hole 56. Rear wall 50*c* similarly includes an upwardly extending aft tab 44. Front and aft tabs 42, 44 extend upwardly above a top edge of walls 40*a* and 40*b*. The interface between side walls 40*a*, 40*b*, and rear and front walls 40*c*, 40*d* may be bevelled, as illustrated. Other geometries are of course possible. For example, vessel 14 might be in the form of a cube; a circular or oval cylinder; or the like.

Vessel 14 may be made of a hard or semi-hard plastic, and may be transparent, translucent or opaque. Vessel 14 may be formed using traditional moulding techniques, including blow or injection moulding.

Cap 12 is depicted in FIGS. 4A-4E. As illustrated, cap 12 may be formed from a single material—such as a soft/medium soft polymer, and includes a flat top surface 50; a dispensing opening 52; and air inlet 54. Dispensing opening 22 is generally circular, centered about ⅓ of the way between back and front of surface 50, along the length of cap 12. Dispensing opening 52 accommodates base 20 of drinking straw assembly 18, to allow it to be friction fit therein. Air inlet 54 is just beside dispensing opening 52. Air inlet 54 allows air to enter vessel 14 as liquid is depleted therefrom.

Cap 12 includes upwardly extending rails 60*a*, 60*b* on either opposing sides of cap 12. Rails 60*a*, 60*b* each define lengthwise extending grooves 62*a*, 62*b*, respectively (best viewed in FIG. 4C). Grooves 62*a*, 62*b* terminate in stop ends 64*a*, 64*b* respectively, that are formed in cap 12.

Indentations 56*a* and 56*b* are found at the front and aft ends of cap 12. Indentation 56*a* is complementary in size and geometry to tab 42 of vessel 14 (FIGS. 3A-3D). Indentation 56*b* is complementary in size and geometry to tab 44 of vessel 14. Cap 12 further include a slight square protrusion 58, complementary in size to hole 46.

Figure 4A:
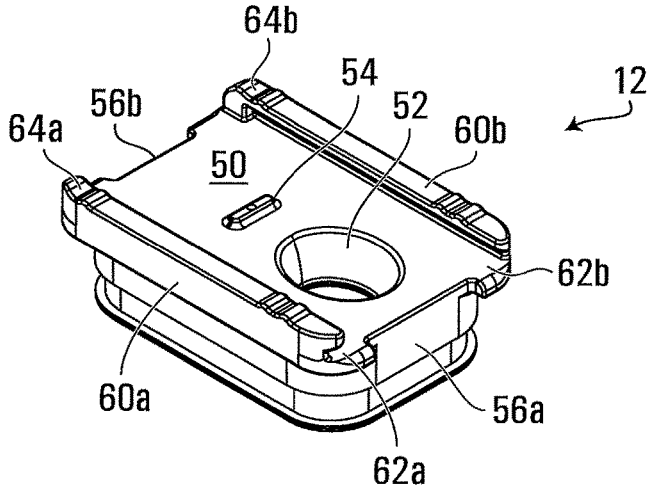
FIG. 4A is a perspective view of a cap of the drinking container of FIG. 1.
Figure 4B:
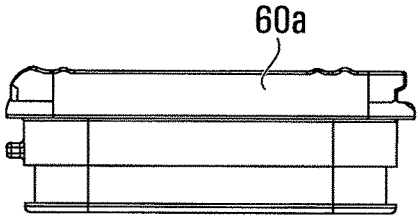
FIG. 4B-4D are side, front and top views of the cap of FIG. 4A.
Figure 4C:
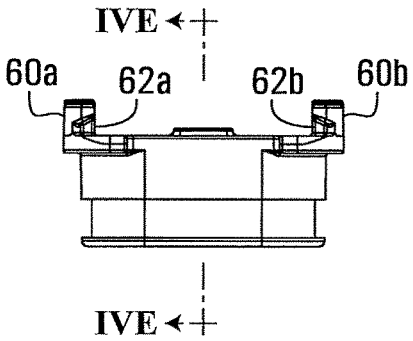
Figure 4D:
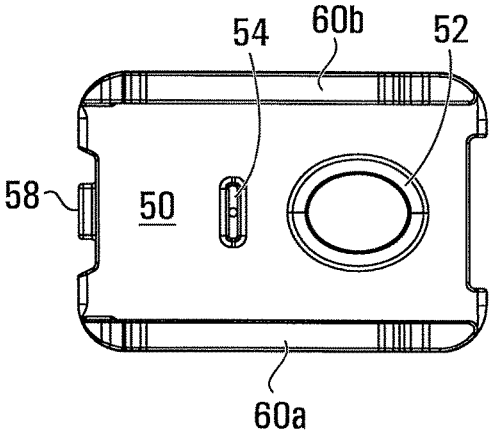
Figure 4E:
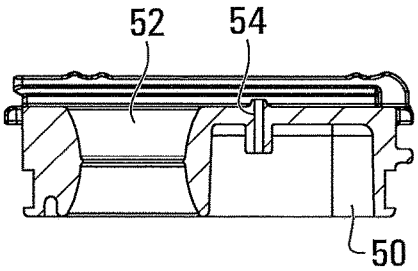
FIG. 4E is a cross-sectional view of FIG. 4, along lines 4E-4E.

As illustrated in cross-section in FIG. 4D (taken along lines 4D-4D of FIG. 4C), drinking opening 52 may be contoured to aid in retaining base 20 of drinking straw assembly 18. Moreover, air inlet 54 may open into a void 59 formed beneath the top surface 50 of cap 12. A rubber valve 26 (FIG. 2) may be place atop the bottom open of inlet 54 within void 59.

The overall height of cap 12 is about 25 mm. Cap 12 may also be formed using known molding techniques.

Lid 16 is depicted in FIGS. 5A-5E. Lid 16, by contrast includes a generally flat top surface 70, and opposing side walls 72*a*, 72*b* extending downward therefrom. Lid 16 further includes a forward end wall 80, extending downward from surface 70. Side walls 72*a*, 72*b* include ribs 74*a*, 74*b* that are complementary to and engage grooves 62*a*, 62*b* of cap 12. Ribs 74*a*, 74*b* thus allow forward and rearward sliding of lid 16 on cap 12, within grooves 62*a*, 62*b*.

Figure 5A:
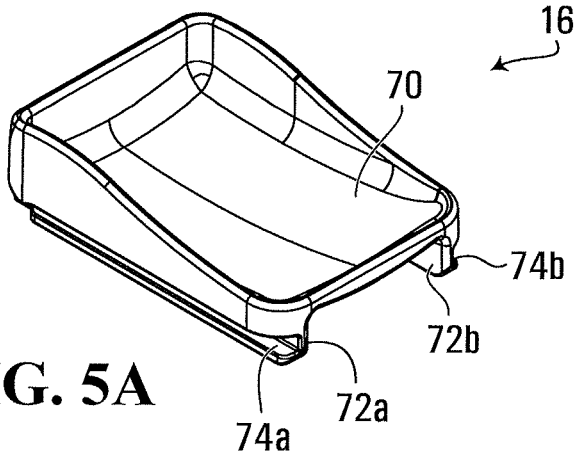
FIG. 5A is a perspective view of a lid of the drinking container of FIG. 1.
Figure 5B:
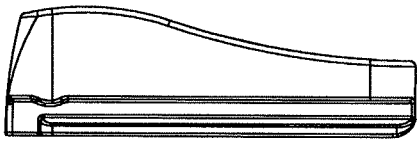
FIG. 5B-5E are side, front, rear and bottom views of the lid of FIG. 5A.
Figure 5C:
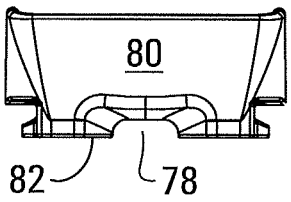
Figure 5D:
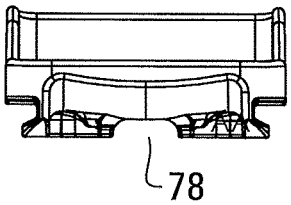
Figure 5E:
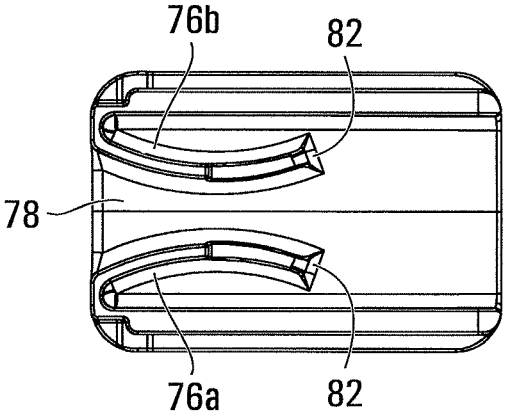

As further illustrated in FIG. 5E, the underside of lid 16 includes spaced rails 76*a*, 76*b*. The depicted rails 76*a*, 76*b* are generally arcuate, with the convex side of the two rails opposing each other, partially forming a passageway 78 there between. The narrow most portion of passageway 78 corresponds to the trough of each of arcuate rails 76*a*, 76*b*, and is sized to be slightly larger than the outer diameter of flexible straw 22, to guide and engage straw 22 as lid 16 is slid along cap 12. The height of rails 76*a*, 76*b* is several millimetres, and allows for passage of lid 16 along the top of cap 12.

Each of rails 76*a*, 76*b* includes a downward extending stop 82 formed as a downwardly extending end surface of rails 76*a* and 76*b*. Stop(s) 82 is/are spaced to engage tab 44 of vessel 14 and serves to prevent sliding of lid 16 backward beyond tab 44, as further discussed below.

Lid 16 may also be formed of a polymer or other suitable material, using known molding techniques.

Figure 6A:
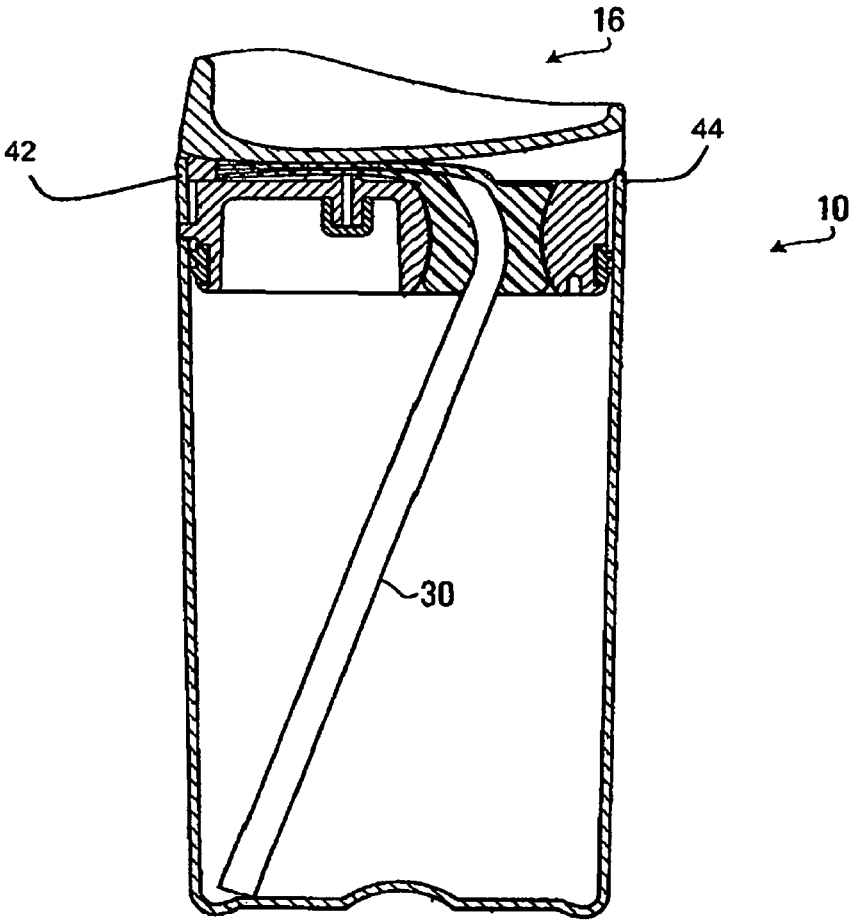
FIGS. 6A and 6B are cross-sectional views of the drinking container of FIG. 1 in use.
Figure 6B:
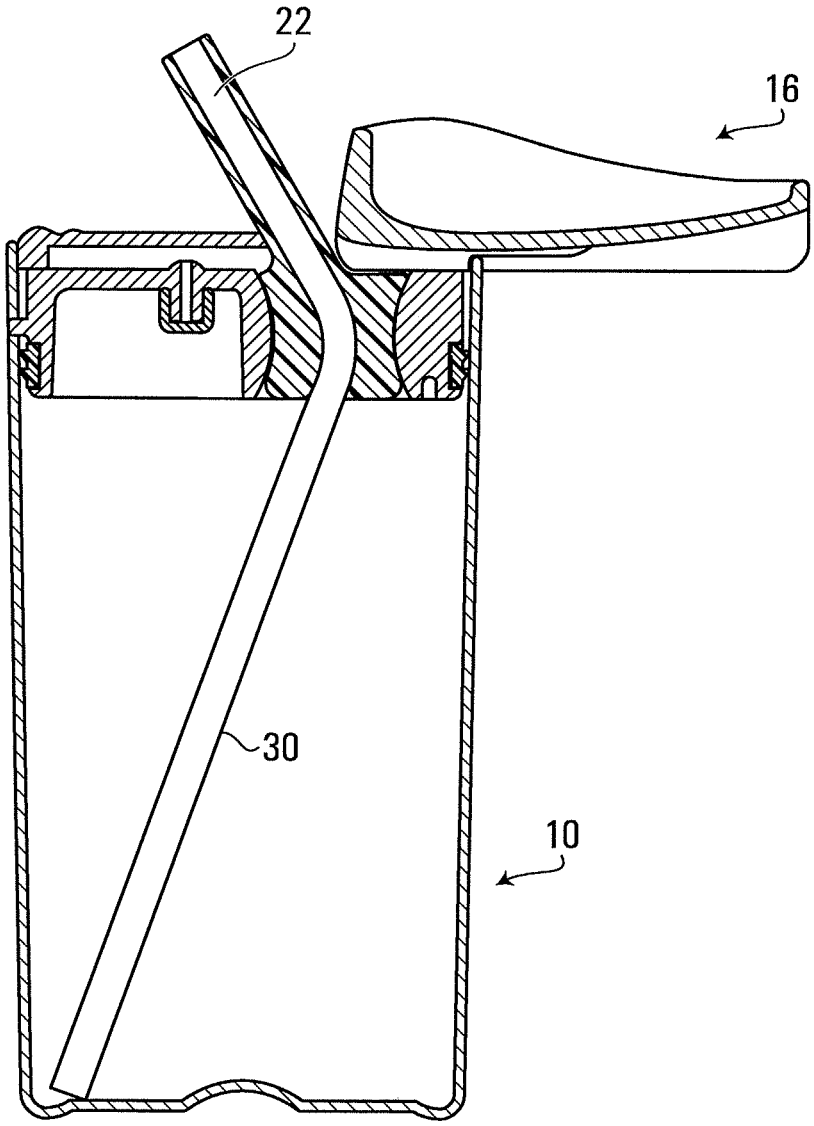

Operation of drinking container 10 may best be appreciated with reference to FIGS. 2, 6A and 6B. Vessel 14 is typically filled with a liquid (not shown). Straw assembly 18 is placed into cap 12 and lid 16 is placed thereon to form a sub-assembly, with lid 16 the front and rear of lid 16 slid into alignment with cap 12. Seal 28 may also be placed around cap 12. Likewise valve 26 may be placed on cap 12.

The sub-assembly of cap 12, lid 16, straw assembly 18 and seal 28 may then be placed within the top opening of vessel 14, until protrusion 58 mates with hole 46. Seal 28 seals cap 12, and protrusion 58 locks cap 12 in place.

The assembled drinking vessel 10 is viewed in cross-section in FIG. 6A. As illustrated, lid 16 in its closed position, causes straw 22 to be flexed into the passageway 78 between the bottom surface of lid 16 defied by rails 76*a*, 76*b*, into. Straw 22 is further bent forward to cover air inlet 54. Moreover, in this closed position, straw 22 may be pinched by being bent forward, and shielded from dirt by lid 16 in abutment with tabs 42 and 44. Rails 76*a*, 76*b* along with the bottom surface of lid 16 and wall 80 thus form a cavity between the bottom of lid 16 and top surface 50 of cap 12 that receives and shields straw 22.

As illustrated in FIG. 6B, lid 16 may be slid backwards. Once slid backwards, the natural flex/bias of straw 22 in base 20 causes straw 20 to extend upwardly for drinking. As well, air inlet 54 is now unobstructed. Further, sliding of lid 16 back and forth is limited through the interaction of stop tab(s) 82 in abutment with tabs 42 and 44, respectively. That is, in the open position of lid 16, the rear of stop(s) 82 is in abutment with tab 44, preventing further sliding of lid 16 rearwardly from cap 12. Likewise, in a closed position of lid 16, the front ends of rails 74*a*, 74*b* are respectively in abutment with rail stops 64*a*, 64*b* in grooves 62*a*, 62*b*, preventing further forward motion of lid 16.

Conveniently then, lid 16 will only come dislodged from drinking container 10 when cap 12 is removed. Once removed, stop tabs 82 are no longer obstructed by tab 44, and lid 16 may be slid backwards from cap 12. Thus, once cap 12 is removed from vessel 14, lid 16 as well as straw assembly 18 may be removed for individual cleaning.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A drinking container comprising a vessel having a top opening;

a cap, seated within said top opening of said vessel;

a flexible drinking straw extending from said cap, in flow communication with an interior of said vessel;

a slidable lid defining a cavity between said cap and said lid;

wherein said lid is slidably mounted to said cap to slide between an open position in which said flexible straw is extended for drinking and a portion of said lid overhangs beyond an outer edge of said cap, to a closed position in which said straw is flexed into said cavity and said lid is co-extensive with a top of said cap.

2. The drinking container of claim 1, wherein said cap further comprises an air inlet to allow air to enter said vessel as liquid is depleted therefrom, and wherein said lid in said closed position urges said flexible drinking straw into contact with said air inlet to obstruct said air inlet.

3. The drinking container of claim 1, wherein said cap comprises two opposing grooves, for slidably receiving said lid.

4. The drinking container of claim 3, wherein said lid comprises two ribs for engaging said two opposing grooves.

5. The drinking container of claim 4, wherein said straw is formed of flexible silicone.

6. The drinking container of claim 1, wherein said lid comprises two downwardly extending rails to guide said flexible straw as said straw is flexed into said cavity.

7. The drinking container of claim 6, wherein said downwardly extending rails at least partially define said cavity.

8. The drinking container of claim 6, wherein said lid comprises a downwardly extending wall, at least partially defining said cavity.

9. The drinking container of claim 8, wherein said vessel comprises an upwardly extending tab that abuts with said downwardly extending wall with said lid in said closed position.

10. The drinking container of claim 1, wherein:

said vessel comprises a tab extending from a rear of said vessel above a top surface of said vessel; and said lid comprises a stop extending downwardly from said lid to engage with said tab to prevent said lid from being slid from said cap, when said cap is mounted atop said vessel;

wherein said cap with said lid mounted thereto is removable from said vessel and said lid is removable from said cap when said cap is removed from said vessel by rearwardly sliding said lid from said cap without engaging said tab.

* * * * *